US011141622B2

(12) United States Patent
Hsu

(10) Patent No.: US 11,141,622 B2
(45) Date of Patent: Oct. 12, 2021

(54) EXERCISE MACHINE

(71) Applicant: GREAT FITNESS INDUSTRIAL CO., LTD., Tainan (TW)

(72) Inventor: Chih-Yung Hsu, Tainan (TW)

(73) Assignee: Great Fitness Industrial Co., Ltd., Tainan (TW)

( * ) Notice: Subject to any disclaimer, the term of this patent is extended or adjusted under 35 U.S.C. 154(b) by 134 days.

(21) Appl. No.: 16/587,166

(22) Filed: Sep. 30, 2019

(65) Prior Publication Data

US 2021/0093913 A1 Apr. 1, 2021

(51) Int. Cl.

| | |
|---|---|
| ***A63B 21/00*** | (2006.01) |
| ***A63B 21/06*** | (2006.01) |
| ***A63B 22/02*** | (2006.01) |
| ***A63B 23/035*** | (2006.01) |

(52) U.S. Cl.

CPC ..... *A63B 21/4035* (2015.10); *A63B 21/0615* (2013.01); *A63B 21/4034* (2015.10); *A63B 22/02* (2013.01); *A63B 23/03541* (2013.01)

(58) Field of Classification Search

CPC ..... A63B 21/00058; A63B 21/00061; A63B 21/00065; A63B 21/0615; A63B 21/062; A63B 21/0624; A63B 21/0626; A63B 21/0628; A63B 21/063; A63B 21/0632; A63B 21/075; A63B 21/4033; A63B 21/4034; A63B 21/4035; A63B 21/4045; A63B 22/02; A63B 23/035; A63B 23/03508; A63B 23/03516; A63B 23/03533; A63B 23/03541; A63B 23/03558; A63B 23/03575; A63B 23/04; A63B 23/12; A63B 23/1209; A63B 23/1227; A63B 2244/09

See application file for complete search history.

(56) References Cited

U.S. PATENT DOCUMENTS 3,501,140 A * 3/1970 Eichorn ..... A63B 21/154 482/130
4,529,194 A * 7/1985 Haaheim ..... A63B 21/012 482/70
4,828,252 A * 5/1989 Bowen ..... A63B 21/078 473/438
4,890,495 A * 1/1990 Slane ..... A63B 21/154 482/51
5,000,440 A * 3/1991 Lynch ..... A63B 21/0615 482/112
5,104,119 A * 4/1992 Lynch ..... A63B 21/00072 482/113
5,171,196 A * 12/1992 Lynch ..... A63B 21/154 482/54

(Continued)

*Primary Examiner* — Gary D Urbiel Goldner
(74) *Attorney, Agent, or Firm* — Rosenberg, Klein & Lee

(57) ABSTRACT

An exercise machine includes a treadmill body and an upper limb weight training mechanism. The upper limb weight training mechanism includes a guide rail, a slider, and a weight unit. The guide rail is fixedly connected to the treadmill body. The slider is connected to the guide rail and is movable upwards and downwards on the guide rail. The slider is provided with a handle. The weight unit is disposed on the slider. The upper limb weight training mechanism can be pulled straight up and down to train upper limb muscles of a user while lower limb muscles of the lower limbs of the user are trained.

6 Claims, 6 Drawing Sheets

(56) References Cited

U.S. PATENT DOCUMENTS 5,207,622 A * 5/1993 Wilkinson ..... A63B 22/0012 482/118
5,318,491 A * 6/1994 Houston ..... A63B 22/001 273/451
5,460,586 A * 10/1995 Wilkinson ..... A63B 22/0012 482/118
5,527,245 A * 6/1996 Dalebout ..... A63B 21/00072 482/103
5,595,556 A * 1/1997 Dalebout ..... A63B 21/015 482/118
5,665,031 A * 9/1997 Hsieh ..... A63B 22/001 482/54
5,951,449 A * 9/1999 Oppriecht ..... A63B 21/0087 482/113
6,146,315 A * 11/2000 Schonenberger ..... A63B 22/02 482/69
6,287,240 B1 * 9/2001 Trabbic ..... A63B 21/015 482/51
6,520,891 B1 * 2/2003 Stephens, Jr. ..... A63B 21/023 482/121
7,462,141 B1 * 12/2008 Raboin ..... A63B 21/225 482/110
7,608,020 B2 * 10/2009 Mason ..... A63B 21/0615 482/105
9,119,988 B2 * 9/2015 Murray ..... A63B 22/0235
9,409,050 B2 * 8/2016 Mintz ..... A63B 22/02
9,907,994 B1 * 3/2018 Maresh ..... A63B 21/00181
10,265,565 B2 * 4/2019 Jue ..... A63B 21/00181
10,342,461 B2 * 7/2019 Basta ..... A61B 5/1038
10,493,309 B2 * 12/2019 Jue ..... A63B 22/02
2006/0128532 A1 * 6/2006 Wang ..... A63B 21/00072 482/54
2006/0135322 A1 * 6/2006 Rocker ..... A63B 23/12 482/54
2007/0232463 A1 * 10/2007 Wu ..... A63B 23/047 482/94
2010/0016127 A1 * 1/2010 Farnsworth ..... A63B 21/4035 482/54
2010/0279827 A1 * 11/2010 Farnsworth ..... A63B 22/02 482/54
2011/0118090 A1 * 5/2011 Ellis ..... A63B 21/4035 482/54
2011/0281691 A1 * 11/2011 Ellis ..... A63B 22/02 482/54
2013/0184125 A1 * 7/2013 Maguire ..... A63B 21/225 482/54
2014/0038792 A1 * 2/2014 Farnsworth ..... A63B 22/02 482/112
2016/0001118 A1 * 1/2016 Kuehne ..... A63B 22/02 482/54
2016/0001119 A1 * 1/2016 Jue ..... A63B 22/02 482/54
2017/0056711 A1 * 3/2017 Dalebout ..... A63B 21/4035
2017/0056715 A1 * 3/2017 Dalebout ..... A63B 21/4035
2017/0056726 A1 * 3/2017 Dalebout ..... A61B 5/11
2017/0144014 A1 * 5/2017 Porteros De Luz ..... A63B 21/4027
2017/0266503 A1 * 9/2017 Watterson ..... A63B 71/0036
2018/0117385 A1 * 5/2018 Watterson ..... A63B 22/025
2018/0126248 A1 * 5/2018 Dion ..... H04L 65/403
2018/0272178 A1 9/2018 Kennedy et al.

* cited by examiner

EXERCISE MACHINE

FIELD OF THE INVENTION

The present invention relates to an exercise machine, and more particularly to an exercise machine comprising a treadmill body and an upper limb weight training mechanism. The upper limb weight training mechanism can be straight pulled up and down to train the muscles of the upper limbs while the muscles of the lower limb are trained.

BACKGROUND OF THE INVENTION

Common exercise machines include treadmills or flywheels that train muscles of the lower limbs, or weight training machines that train the muscles of the upper limbs.

However, these exercise machines occupy a certain space. For narrow spaces, such as homes, it will be a problem for an exercise machine to be furnished. In addition, a training machine for a single part of the human body can only train a single part of the human body at one time. For example, when training the muscles of the lower limbs and the muscles of the upper limbs, the trainee needs to select one of a treadmill, a flywheel, and a weight training machine. After training one part of the human body, it is necessary to use another training machine to train another part of the human body. However, this training way takes a lot of time. It is not beneficial for constant training. If the training time is limited, only a single part of the human body can be trained.

US Patent Application Publication No. US20180272178 discloses "Apparatus, System, and Method for Exercise Equipment with Carry Arms". In this application, a pivotable swing arm is pivotally connected to the treadmill. Weight plates of different weights can be selectively mounted on the swing arm. When the trainee uses the treadmill to train the muscles of the legs, the swing arm can be operated and pivoted to train the muscles of the hands simultaneously.

However, the weight plates are mounted on the swing arm, and the swing arm is in a pivotal state. When the user lifts the weight plates with the hand, the user's hand moves up and down in a curved path, not in a straight line.

SUMMARY OF THE INVENTION

The primary object of the present invention is to provide an exercise machine that comprises a treadmill body and an upper limb weight training mechanism mounted on the treadmill body. The upper limb weight training mechanism can be straight pulled up and down to train the muscles of the upper limbs and to increase the training strength of the lower limbs when using the treadmill.

An exercise machine comprises a treadmill body and an upper limb weight training mechanism disposed on the treadmill body. The upper limb weight training mechanism comprises a guide rail, a slider, and a weight unit. The guide rail is fixedly connected to the treadmill body. The slider is connected to the guide rail and moved back and forth on the guide rail. The slider is provided with a handle. The weight unit is disposed on the slider.

Preferably, the treadmill body has a training area. The upper limb weight training mechanism is disposed on two opposite sides of the training area.

Preferably, the weight unit is adjustable so that the weight of the weight unit can be adjusted.

Preferably, the weight unit includes a fixing rod fixed to the slider and a plurality of weight plates to be selectively hung on the fixing rod.

Preferably, the fixing rod is inclined upward by an angle.

Preferably, the guide rail extends in a height direction of the treadmill body. Furthermore, the guide rail is vertically disposed on the treadmill body in the height direction.

Preferably, the handle has a grip. The grip is parallel to a simulated motion direction of the treadmill body.

According to the above technical features, the following effects can be achieved:

1. The weight unit of the upper limb weight training mechanism is straight moved up and down, which is ergonomic.

2. The treadmill body is integrated with the upper limb weight training mechanism. When using the treadmill, the upper limbs can be trained by the upper limb weight training mechanism, and the training strength of the lower limbs can be increased through the weight of the weight unit.

3. The weight unit of the upper limb weight training mechanism includes the fixing rod and the weight plates. The weight of the weight unit can be adjusted easily. The fixing rod is inclined upward so that the weight plates will not fall after being mounted.

4. The guide rail is vertically arranged in the height direction of the treadmill body. The weight training mechanism is straight pulled up and down, which conforms to the habit that the upper limbs exert a force. The grip of the handle is parallel to the simulated motion direction of the treadmill body, so the grip can be held more conveniently.

DETAILED DESCRIPTION OF THE PREFERRED EMBODIMENTS

Embodiments of the present invention will now be described, by way of example only, with reference to the accompanying drawings.

Figure 1:
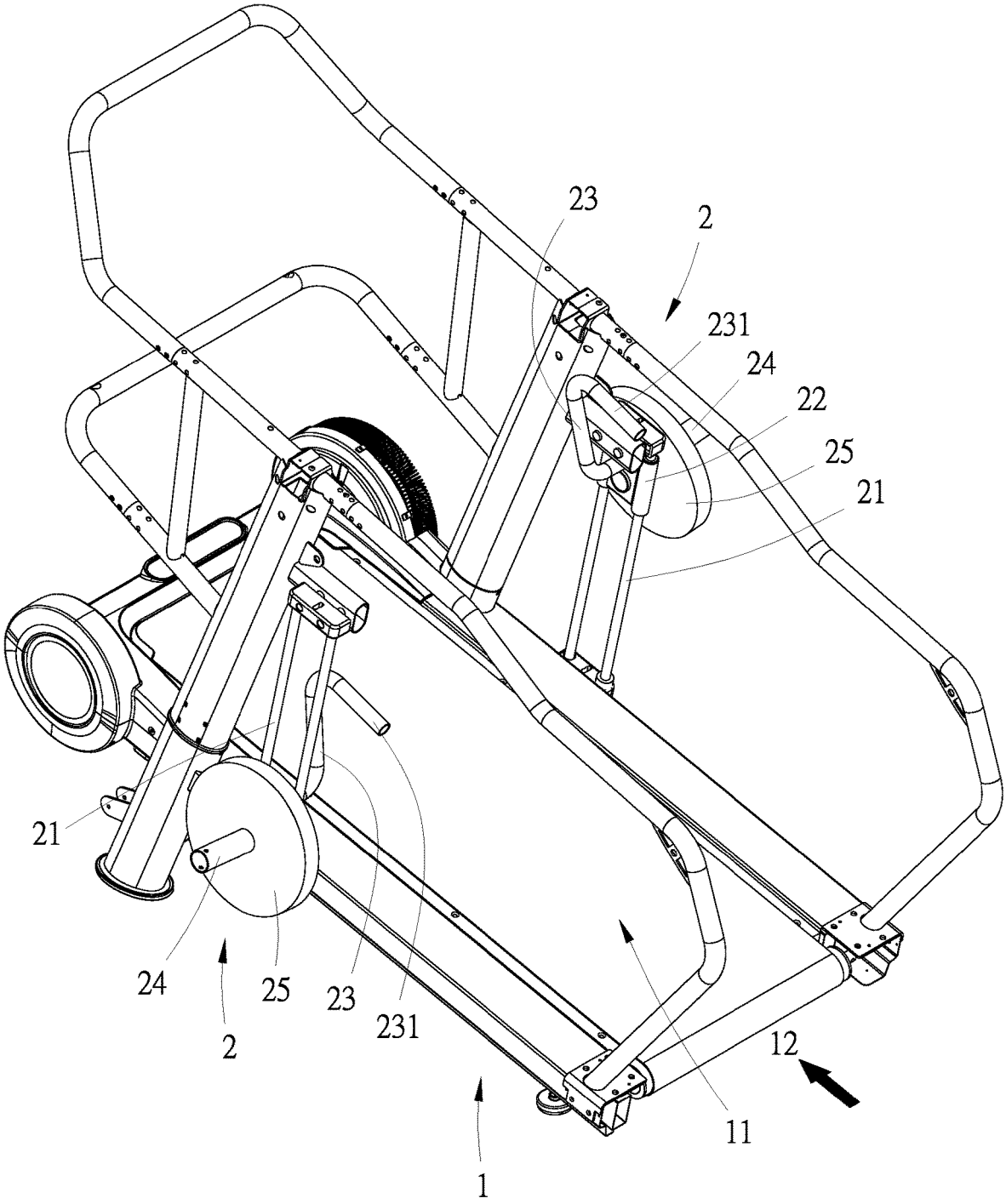
FIG. 1 is a perspective view of the present invention.

Referring to FIG. 1, an exercise machine in accordance with an embodiment of the present invention comprises a treadmill body (1) and an upper limb weight training mechanism (2) disposed on the treadmill body (1). The treadmill body (1) has a training area (11) on which a simulated motion direction (12) is defined. In this embodiment, the treadmill body (1) has a training area (11) that is a running area of the treadmill. The simulated motion direction (12) is opposite to the running direction of the treadmill belt of the treadmill. Two opposite sides of the training area (11) are provided with the upper limb weight training mechanisms. The treadmill body (1) is integrated with the upper limb weight training mechanism (2), thereby solving the problem that different training machines occupy much space.

Figure 2:
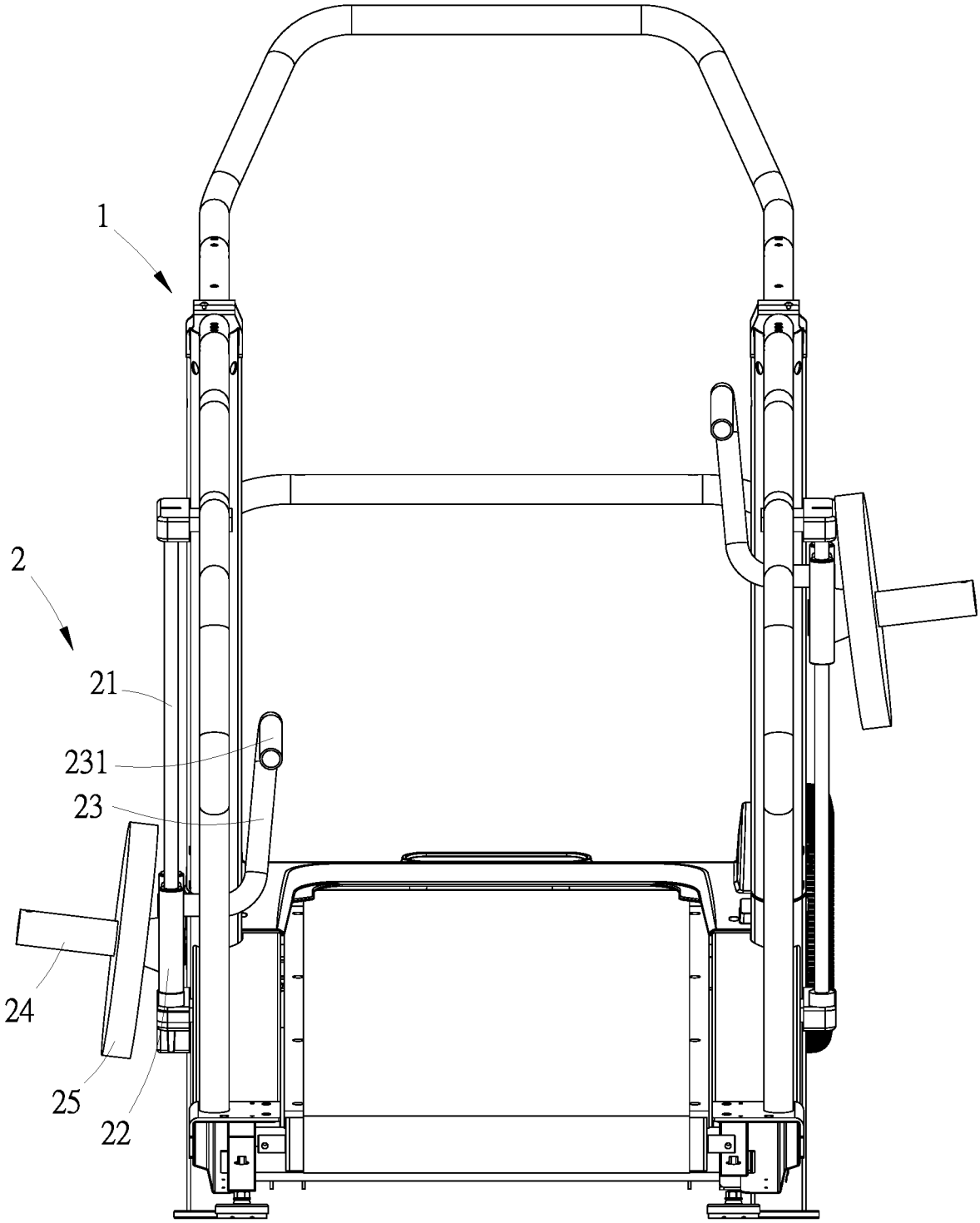
FIG. 2 is a rear view of the present invention.
Figure 3:
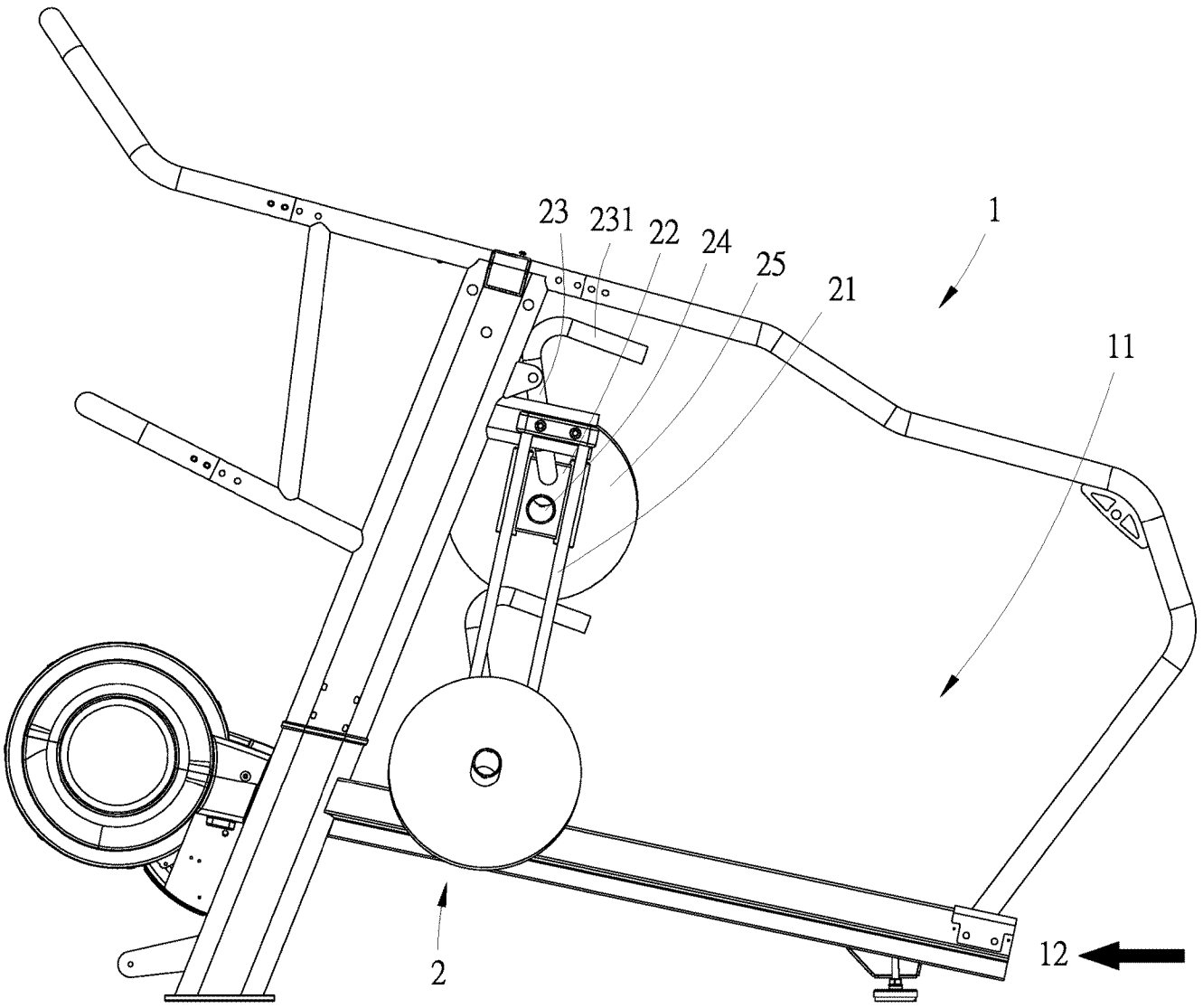
FIG. 3 is a side view of the present invention.

Referring to FIG. 1 to FIG. 3, the upper limb weight training mechanism (2) includes a guide rail (21), a slider (22), and a weight unit. The guide rail (21) is fixedly connected to the treadmill body (1). The guide rail (21) is vertically arranged in the height direction of the treadmill body (1). The slider (22) is connected to the guide rail (21) and moved back and forth on the guide rail (21). The slider (22) is provided with a handle (23). The handle (23) has a grip (231). The grip (231) is parallel to the simulated motion direction (12). The weight unit is disposed on the slider (22). In this embodiment, the weight unit is adjustable so that the weight of the weight unit can be adjusted. The specific structure of the weight unit includes a fixing rod (24) fixed to the slider (22) and a plurality of weight plates (25) to be selectively hung on the fixing rod (24). The fixing rod (24) is inclined upward by an angle so that the weight plates (25) will not fall after being mounted on the fixing rod (24).

Figure 4:
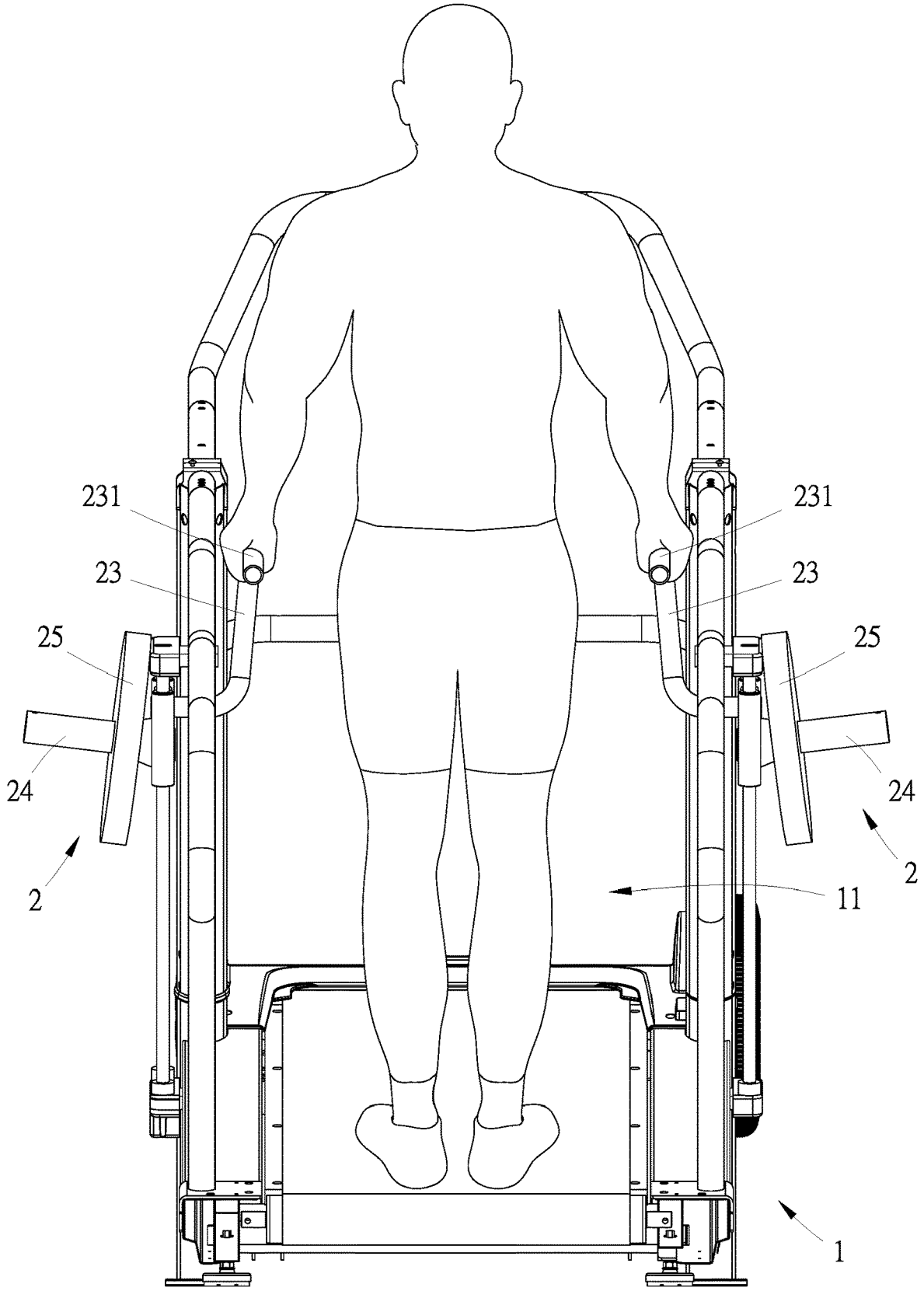
FIG. 4 is a first schematic view showing the operation of the present invention.
Figure 5:
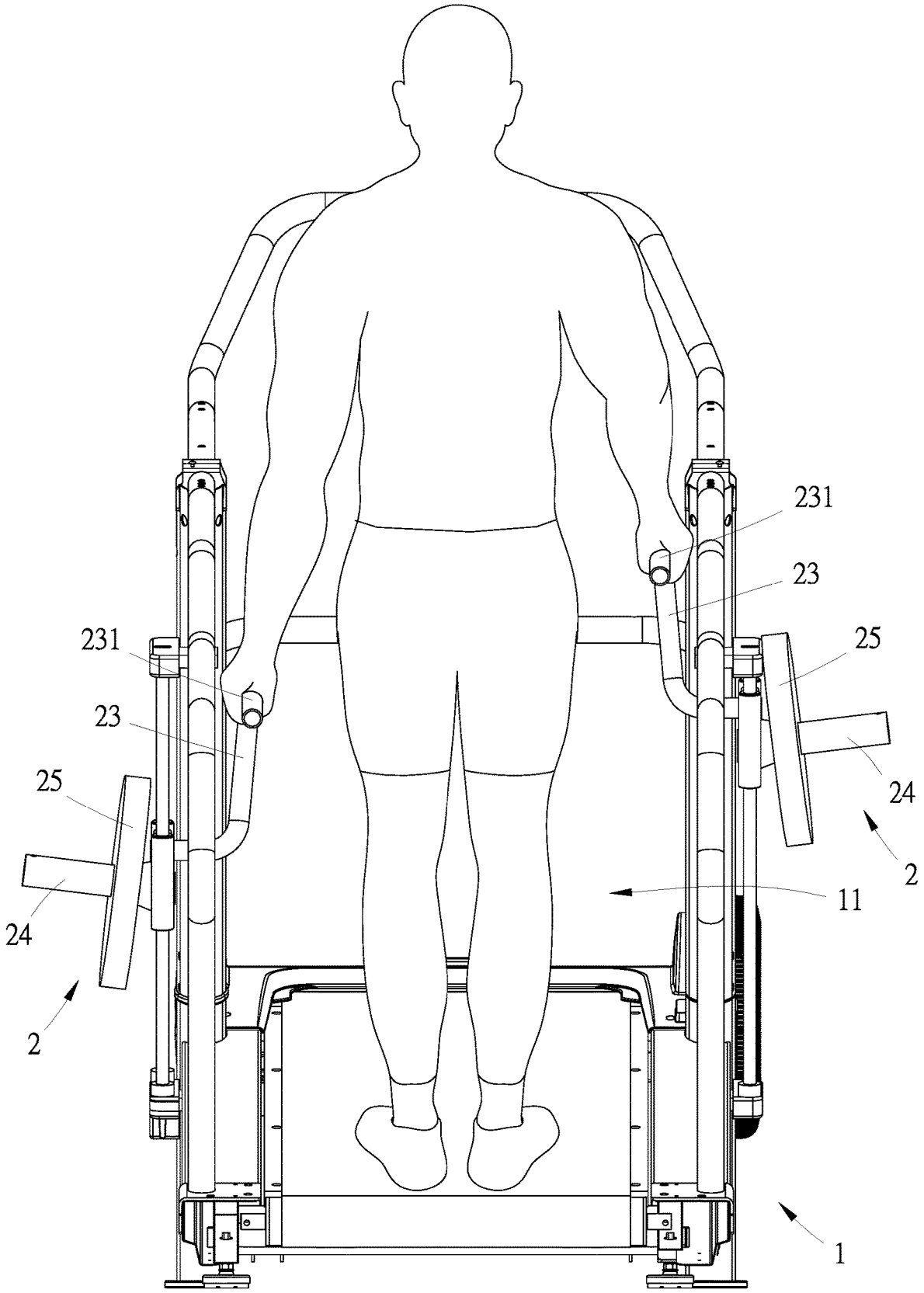
FIG. 5 is a second schematic view showing the operation of the present invention.

Referring to FIG. 4 and FIG. 5, when in use, the trainee first selects an appropriate weight plate (25), and then the weight plate (25) is hung on the fixing rod (24). When the trainee enters the training area (11) of the treadmill body (1) for leg training, he/she holds the grips (231) of the upper limb weight training mechanisms (2) on both sides of the treadmill body (1) with both hands and pulls the grips (231) upward, so that the handle (23) can drive the slider (22) to be lifted along the guide rail (21) while pulling the weight plate (25) up. In the lifting process, the weight of the weight plate (25) can achieve the effect of training the muscles of the upper limbs. Besides, in the training process, the user maintains the action of lifting the weight plate (25) and continues to run/walk in the training area (11) of the treadmill body (1). With the weight of the weight plate (25) that is lifted by the upper limbs to increase the load of the lower limbs, the training strength of the lower limbs is increased greatly. The extension direction of the grip (231) is parallel to the simulated motion direction (12) of the treadmill body (1) (referring to the simulated motion direction (12) in FIG. 3), so that the grip (231) can be held easily. In this way, the lower limb muscles and the upper limb muscles can be trained simultaneously so as to save the training time. The weight training in a straight pull manner conforms to habit that the user exerts a force.

As shown in FIG. 4, when the user uses the treadmill body (1), the user's both hands continue to lift the upper limb weight training mechanisms (2), which can effectively increase the load of the lower limbs to increase the training strength of the lower limbs.

As shown in FIG. 5, when the user uses the treadmill body (1), both hands of the user continue to lift the upper limb weight training mechanisms (2). In addition to effectively increase the load of the lower limbs to increase the training strength of the lower limbs, the hands are lifted and lowered continuously to train the muscles of the upper limbs. The upper limb weight training mechanisms (2) can be lifted "by turns" with both hands, or the upper limb weight training mechanisms (2) can be lifted or lowered "synchronously" with both hands to achieve the same training effect.

Figure 6:
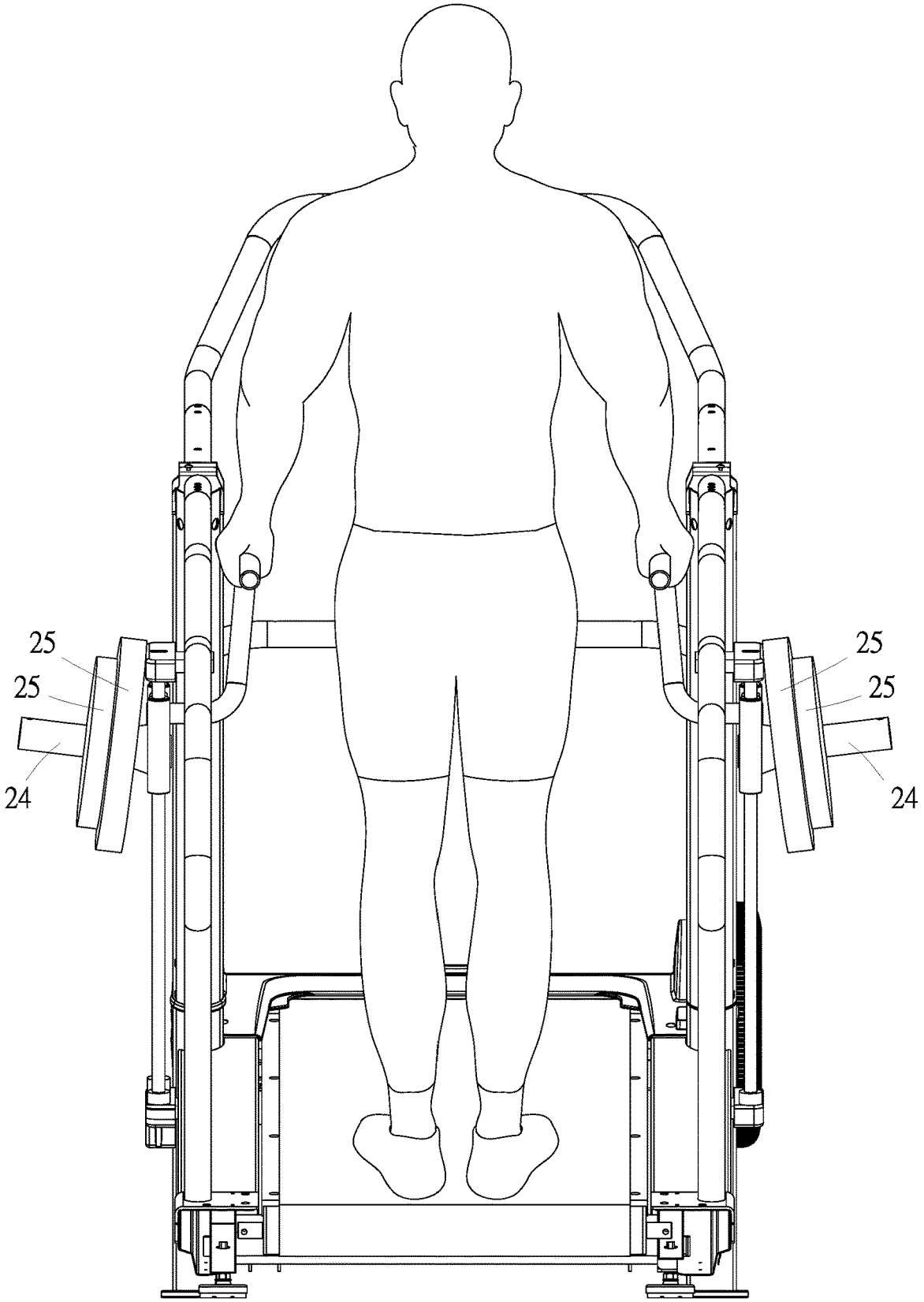
FIG. 6 is a schematic view of the present invention when in use, illustrating that the weight of the upper limb weight training mechanism is adjusted.

Referring to FIG. 6, when the muscles of the trainee's arm can withstand a greater load, or other trainees able to withstand a great load, the number of weight plates (25) on the fixing rod (24) can be increased to perform greater weight training.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An exercise machine, comprising:

a treadmill body;

an upper limb weight training mechanism, disposed on the treadmill body, the upper limb weight training mechanism comprising:

a guide rail, fixedly connected to the treadmill body;

a slider, connected to the guide rail and movable upwards and downwards on the guide rail, the slider being provided with a handle;

a weight unit, disposed on the slider, wherein the weight unit includes a fixing rod fixed to the slider and a plurality of weight plates to be selectively hung on the fixing rod to adjust a weight of the weight unit.

2. The exercise machine as claimed in claim 1, wherein the treadmill body has a training area, and the upper limb weight training mechanism is disposed on two opposite sides of the training area.

3. The exercise machine as claimed in claim 1, wherein the fixing rod is inclined upward by an angle.

4. The exercise machine as claimed in claim 1, wherein the guide rail extends in a height direction of the treadmill body.

5. The exercise machine as claimed in claim 4, wherein the guide rail is vertically disposed on the treadmill body in the height direction.

6. The exercise machine as claimed in claim 1, wherein the handle has a grip, and the grip extends in a simulated motion direction of the treadmill body.

* * * * *